US010081459B2

(12) United States Patent
Painchaud et al.

(10) Patent No.: US 10,081,459 B2
(45) Date of Patent: Sep. 25, 2018

(54) DEVICE FOR CLOSING A CONTAINER COMPRISING SECURE CLOSURE MEANS

(71) Applicant: Nemera La Verpillière S.A.S., La Verpilliere (FR)

(72) Inventors: Gaëtan Painchaud, Francheville (FR); Frederic Alfonsi, Lyons (FR); Thierry Decock, Lyons (FR)

(73) Assignee: Nemera La Verpillière S.A.S. (FR)

( * ) Notice: Subject to any disclaimer, the term of this patent is extended or adjusted under 35 U.S.C. 154(b) by 201 days.

(21) Appl. No.: 15/043,078

(22) Filed: Feb. 12, 2016

(65) Prior Publication Data

US 2016/0236832 A1 Aug. 18, 2016

(30) Foreign Application Priority Data

Feb. 13, 2015 (FR) ..... 15 51229

(51) Int. Cl.

| | |
|---|---|
| ***B65D 45/30*** | (2006.01) |
| ***B05B 11/00*** | (2006.01) |
| ***B65D 50/04*** | (2006.01) |
| ***A61J 1/14*** | (2006.01) |
| ***B65D 51/18*** | (2006.01) |
| *B65D 47/18* | (2006.01) |

(52) U.S. Cl.

CPC ..... *B65D 45/305* (2013.01); *A61J 1/1425* (2015.05); *B05B 11/0032* (2013.01); *B65D 50/046* (2013.01); *B65D 51/18* (2013.01); *B05B 11/3047* (2013.01); *B65D 47/18* (2013.01); *B65D 2251/0015* (2013.01); *B65D 2251/0087* (2013.01)

(58) Field of Classification Search

CPC .... B65D 45/305; B65D 51/18; B65D 50/046; B65D 2251/0087; B65D 2251/0015; B65D 47/18; A61J 1/1425; B05B 11/0032; B05B 11/3047

USPC ..... 215/209, 216, 221

See application file for complete search history.

(56) References Cited

U.S. PATENT DOCUMENTS 4,061,239 A * 12/1977 Tasseron ..... B65D 50/046 215/221
4,948,002 A * 8/1990 Thornock ..... B65D 50/046 215/216

(Continued)

FOREIGN PATENT DOCUMENTS

CH 613907 A5 10/1979
WO 9855373 A2 12/1998

*Primary Examiner* — James N Smalley
(74) *Attorney, Agent, or Firm* — St. Onge Steward Johnston & Reens, LLC

(57) ABSTRACT

A closure device designed to be put in place on, or removed from, a container, including a cap carrying at least two security projections, each provided with an axial locking abutment that can be moved radially between a cooperation position, in which the axial locking abutment engages with an axial locking abutment carried by the container, in order to hold the cap on the container, and a separation position, in which the axial locking abutment is separated from the axial locking abutment carried by the container. The closure device further includes a security ring snap-fitted onto the cap. The security projections are arranged on an internal surface of the security ring and the radial position of each axial locking abutment changes, by ovalization, from its cooperation position to its separation position.

14 Claims, 3 Drawing Sheets

(56) References Cited

U.S. PATENT DOCUMENTS

| | | | | |
|---|---|---|---|---|
| 5,078,288 | A * | 1/1992 | Fuchs | B65D 50/046 215/209 |
| 5,765,705 | A * | 6/1998 | Deubel | B65D 50/045 215/216 |
| 2004/0149756 | A1 | 8/2004 | Kaufman et al. | |
| 2009/0255896 | A1 * | 10/2009 | DeJonge | B65D 41/06 215/206 |

* cited by examiner

DEVICE FOR CLOSING A CONTAINER COMPRISING SECURE CLOSURE MEANS

FIELD OF THE INVENTION

The present invention concerns a closure device that is intended to be mounted on the neck of a container also referred to as a reservoir. The container is for example intended to receive a pharmaceutical product in fluid form and may be fitted with a dispensing pump, possibly a metered dispensing pump.

BACKGROUND OF THE INVENTION

In known manner, pharmaceutical products are offered for sale in bottles usually comprising a reservoir having a neck on which is mounted a dispensing tip forming a metering pump, for example.

The dispensing tip is conventionally protected by a closure device including a cap intended to be placed on the container or to be removed from that container by relative movement between the cap and the container including an axial component.

Thus it is known to equip the closure device with means for snap-fitting the cap onto the container that can be activated by substantially axial relative movement between the cap and the container. In this first case, the cap is placed on the container or removed from that container by a relative movement between the cap and the container including only an axial component. It is also known to use a cap having an interior screwthread screwed onto an exterior screwthread of the neck of the container. In this second case, the cap is placed on the container or removed from that container by a relative movement between the cap and the container including an axial component and a rotation component producing a screwing action.

To access the dispensing tip, it then suffices, in the first case, to pull axially on the cap, a moderate traction force generally being sufficient to unlock the snap-fitting means by overcoming a localized resistance and, in the second case, to unscrew the cap, by applying a rotation force that is likewise moderate.

This makes it possible to render the dispensing tip accessible to everyone, including persons with little strength, for example elderly persons or convalescent persons.

The drawback is that a child can also easily access the dispensing tip and therefore the contents of the reservoir, which may be hazardous in some cases.

Moreover, as regulations evolve, more and more countries require bottled pharmaceutical products placed on sale in their territory to have secure closure means commonly referred to as child resistant closure (CRC) packaging. Such secure means for example enable a cap to be removed only by movements that are a priori mutually contradictory. These means are often difficult to use, however, and often require a relatively high physical force.

Also known, from documents CH 613 907 and US 2004/149756, are devices for closing a container, of the type including a cap intended to be placed on the container or to be removed from that container by a relative movement between the cap and the container including an axial component, the cap carrying at least two essentially diametrically opposite security projections, each provided with an axial locking abutment that can be moved radially between:

- a so-called cooperation position, favored by elastic biasing, in which the locking abutment is intended to cooperate with a complementary locking abutment carried by the container to retain the cap on the container,
- a so-called separation position, in which the locking abutment is intended to be separated from the complementary locking abutment carried by the container to allow the release of the cap relative to the container, further comprising a security ring mounted around the cap so as to allow radial elastic deformation thereof by ovalization when the security ring is compressed radially in at least one "compression" direction, the security projections being arranged on an internal surface of the security ring and aligned in a direction essentially perpendicular to the compression direction, the radial position of each axial locking abutment carried by the security ring changing, by ovalization of this security ring, from its cooperation position to its separation position.

SUMMARY OF THE INVENTION

The object of the invention is to propose a device for closing a container provided with secure closure means that are effective but simple to use.

To that end, the invention relates to a device for closing a container, of the type including a cap assembly including a cap intended to be placed on the container or to be removed from that container by a relative movement between the cap and the container including an axial component, the cap carrying at least two essentially diametrically opposite security projections, each provided with an axial locking abutment that can be moved radially between:

- a so-called cooperation position, favored by elastic biasing, in which the locking abutment is intended to cooperate with a complementary locking abutment carried by the container to retain the cap on the container,
- a so-called separation position, in which the locking abutment is intended to be separated from the complementary locking abutment carried by the container to allow the release of the cap relative to the container, further comprising a security ring mounted around the cap so as to allow radial elastic deformation thereof by ovalization when the security ring is compressed radially in at least one "compression" direction,

- the security projections being arranged on an internal surface of the security ring and aligned in a direction essentially perpendicular to the compression direction,
- the radial position of each axial locking abutment carried by the security ring changing, by ovalization of this security ring, from its cooperation position to its separation position,
- and comprising means for snap-fitting the security ring onto the cap, which can be activated by means of an essentially axial relative movement between the security ring and the cap, these means for snap-fitting the security ring onto the cap being active regardless of whether or not the security ring is ovalized.

It is noted that the ovalization of a ring by radial compression causes in particular, on one hand, a reduction in the diameter of the ring which corresponds to the compression direction and, on the other hand, an increase in the diameter of the ring which corresponds to a direction essentially perpendicular to the compression direction.

By virtue of the invention, in order to separate the cap from the retaining member, all that is necessary, before making the usual motion of removing the cap, is to radially grip the security ring in order to ovalize the latter, with a first hand. This places the axial locking abutment of each security projection in its separation position allowing the cap to be released from the container.

Then, with a second hand, the cap is separated from the container by the usual motion, effecting a movement between the cap and the container comprising an axial component.

Generally speaking, a child will not combine these two motions without being prompted to do so, such that the closure of the container is effectively secured with respect to accidental handling by a child.

Furthermore, the force which a user has to provide in order to separate the cap from the retaining member remains moderate, or even lower than that which is required by a conventional device for closing a container. Indeed, the ovalization of the security ring is obtained by means of pressure which remains moderate and places the axial locking abutment of each security projection in the separation position, allowing the cap to be released from the container, without overcoming a localized resistance.

Finally, the means for snap-fitting the security ring onto the cap, which can be activated by means of an essentially axial relative movement between the security ring and the cap, and which are active regardless of whether or not the security ring is ovalized, make it possible to keep the security ring in place on the cap regardless of whether or not it is ovalized.

The fact that these two elements are connected by snap-fitting has the advantage that only the ring is deformed upon ovalization, and not the cap. It is thus for example possible to make the cap from a more rigid material than that of the ring in order to provide better protection for the device.

The invention may also comprise the following optional features.

Advantageously, the security ring is generally oval in shape, the two security projections being essentially aligned with the minor axis of the security ring, the security ring being ovalized by deforming it elastically so as to reduce its major axis.

Preferably, each security projection arranged on the security ring extends radially, from the internal surface of the security ring toward the security projection diametrically opposite, through a notch or an orifice of the cap.

This makes it possible to ensure a good hold of the security ring on the cap, while permitting effective engagement between the security projections carried by the ring and the axial locking abutment of the container.

The means for snap-fitting the security ring onto the cap may comprise at least one pair of snap-fitting projections, for example three pairs of snap-fitting projections, the snap-fitting projections of each pair being arranged essentially diametrically opposite one another on the internal surface of the security ring by being angularly offset with respect to the security projections, the snap-fitting projections engaging in a form-fitting manner with complementary snap-fitting orifices created in the cap, so as to remain in a form fit in these snap-fitting orifices upon ovalization of the security ring.

Advantageously, each snap-fitting orifice is delimited by a ramp for retracting the corresponding snap-fitting projection designed to engage with this snap-fitting projection before form-fitting this snap-fitting projection with the corresponding snap-fitting orifice, taking into account the essentially axial snap-fitting relative movement between the security ring and the cap.

According to one possible variant, the means for snap-fitting the security ring onto the cap may comprise at least one annular channel portion created in the cap, into which a portion of the security ring at least partially fits, the security ring remaining fitted in the channel portion upon ovalization of the security ring.

The annular channel portion may be delimited by a ramp for radial elastic expansion of the security ring, designed to engage with this security ring before form-fitting of this security ring, taking into account the essentially axial snap-fitting relative movement between the security ring and the cap.

The security ring may also be angularly immobilized around the cap by immobilization means having complementary shapes created on the security ring and the cap, at least one part of these immobilization means remaining active upon ovalization of the security ring.

The invention also relates to a medical device comprising a container and a closure device for this container, wherein the closure device is according to the invention.

The medical device according to the invention may also comprise the following optional features:

- it may comprise means for snap-fitting the cap onto the container, which can be activated by means of an essentially axial relative movement between the cap and the container, the complementary axial locking abutment forming part of these means for snap-fitting the cap onto the container,
- taking into account the essentially axial relative movement for snap-fitting the cap onto the container, each security projection may be designed to engage with a ramp for retracting this security projection carried by the container before the axial locking abutment of each security projection is put in the cooperation position,
- the complementary axial locking abutment may be carried by a member for retaining the cap on the container, this retaining member, forming for example a tip for dispensing a product contained in the container, being designed to be mounted on the container or being in one piece with this container.

BRIEF DESCRIPTION OF THE DRAWINGS

The invention will be better understood in light of the appended exemplary, non-limiting figures, in which.

DETAILED DESCRIPTION OF THE INVENTION

Figure 1:
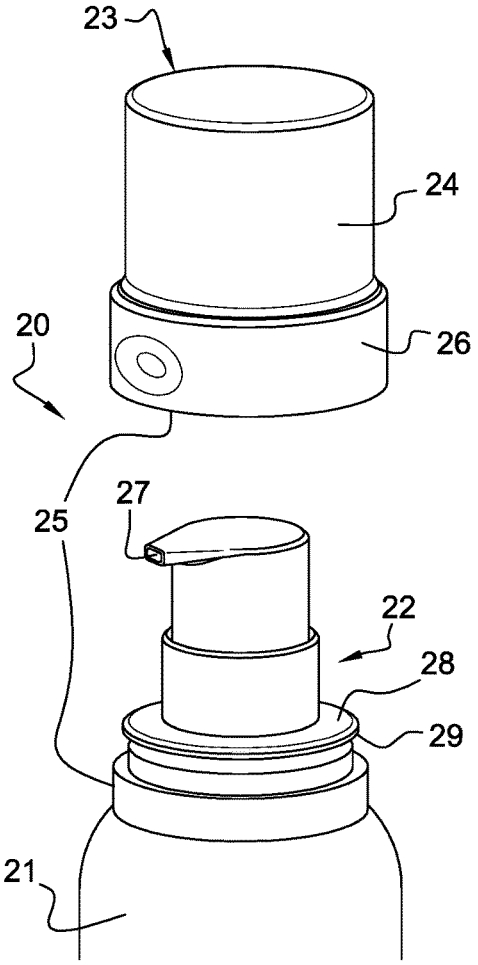
FIGS. 1 and 2 are perspective views of a medical device comprising a closure device, according to a first embodiment of the invention, affixed to a container, respectively in two use configurations of this closure device.
Figure 2:
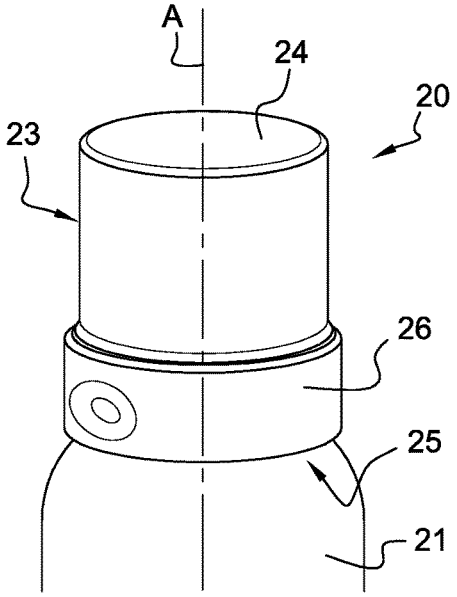

Shown in FIGS. 1 and 2 is a medical device 20 according to the invention. This medical device 20 comprises a container 21 having a general shape which is axisymmetric about an axis A, forming a reservoir, onto which is affixed a tip 22 for dispensing a product contained in the container 21. As a variant, this dispensing tip 22 could be in one piece with the container 21.

The medical device 20 also comprises a device 23 for closing the container 21.

The closure device 23 comprises a cap 24 designed to be put in place on the container 21 or to be removed from this container 21 by means of a relative movement between the cap 24 and the container 21 comprising an axial component parallel to the axis A.

More particularly, in order to retain the closure device 23 on the container 21, the medical device 20 comprises means 25 for snap-fitting the cap 24 onto the dispensing tip 22, which can be activated by means of an essentially axial relative movement between this cap 24 and this dispensing tip 22.

The snap-fitting means 25 comprise a security ring 26 mounted around the cap 24 so as to allow radial elastic deformation thereof by ovalization when the security ring 26 is compressed radially in a "compression" direction, as will be set out in more detail below.

The snap-fitting means 25 also comprise complementary axial locking abutments carried by the dispensing tip 22 and the security ring 26.

Thus, the dispensing tip 22 has, in a manner known per se, a dispensing nozzle 27 which can be activated by a user of the medical device 20 by moving this dispensing nozzle 27 axially counter to an elastic biasing force Moreover, as shown in FIG. 1, the dispensing tip 22 comprises a collar 28, forming an axial locking abutment 29 of the closure device 23.

Figure 3:
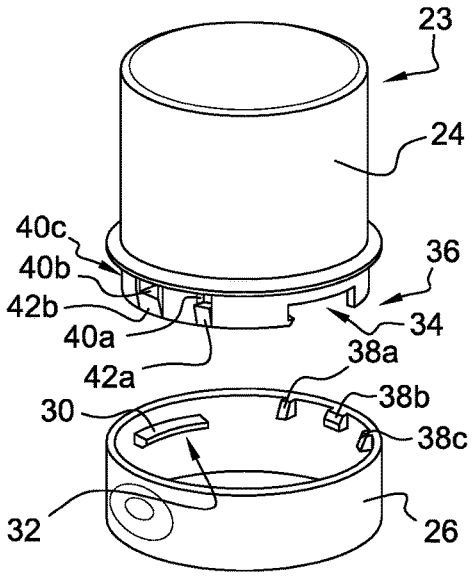
FIG. 3 is an exploded perspective view of the closure device shown in FIGS. 1 and 2.

Furthermore, as shown in FIG. 3, the security ring 26 of the cap 24 comprises two essentially diametrically opposite locking abutments 30, referred to as security abutments, which are carried by two internal radial projections 32 of the security ring 26.

The two security projections 32 are arranged on the internal surface of the security ring 26, being essentially aligned in a direction essentially perpendicular to the compression direction.

The axial locking abutments 29, 30 of the dispensing tip 22 and of the security ring 26 therefore form the complementary axial locking abutments of the snap-fitting means 25.

Each axial locking abutment 30 can be displaced radially. Indeed, the radial position of each axial locking abutment 30 carried by the security ring 26 changes, by ovalization of this security ring 26, from an "engagement" position toward a "separation" position.

In the cooperation position (shown in FIG. 2), the complementary axial locking abutments 29, 30 of the dispensing tip 22 and of the security ring 26 engage with one another to hold the cap 24 on the dispensing tip 22 of the container 21.

The cooperation position is furthermore favored by an elastic biasing established by a material having an elastic effect being used to make the security ring 26.

In the separation position (shown in FIG. 1), the axial locking abutments 30 of the security ring 26 are separated from the complementary axial locking abutment 29 of tip 22 of the container 21 so as to allow the cap 24 to be released from this tip 22 of the container 21.

The dispensing tip 22 thus forms a member for retaining the cap 24 on the container 21.

Since the axial locking abutment 28 carried by the dispensing tip 22 is axisymmetric, this makes it possible to place the cap 24 on the dispensing tip 22 in any angular position about the axis A.

Figure 5:
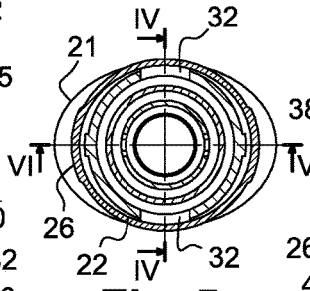
FIG. 5 is a view from above, in section along the line V-V of FIG. 6, of the closure device shown in the preceding figures, the axial locking abutments being in their cooperation position in order to hold the cap on the container, elements of the closure device having been removed for a better view of the security ring.

Preferably, as shown in FIG. 3, the security ring 26 is generally oval in shape and the two security projections 32 are essentially aligned with its minor axis corresponding to the plane of section IV of FIG. 5.

Figure 4:
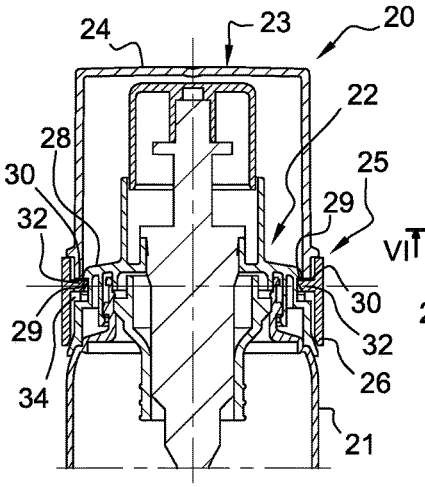
FIG. 4 is a view in axial section, along the line IV-IV of FIG. 5, of the closure device shown in the preceding figures.

In order for the axial locking abutments 29, 30 of the dispensing tip 22 and of the security ring 26 to be able to engage, each security projection 32 extends radially, from the internal surface of the security ring 26 toward the security projection 32 diametrically opposite, through a notch 34 in the cap 24. It is thus apparent, as shown in FIG. 4, that, in the cooperation position, the axial locking abutments 29, 30 of the tip 22 and of the security ring 26 engage through the notch 34 in the cap 24.

The closure device 23 also comprises means 36 for snap-fitting the security ring 26 onto the cap 24. These snap-fitting means 36 can be activated by means of an essentially axial relative movement between the security ring 26 and the cap 24. It is to be noted that the means 36 for snap-fitting the security ring 26 onto the cap 24 are active regardless of whether or not the security ring 26 is ovalized.

Figure 6:
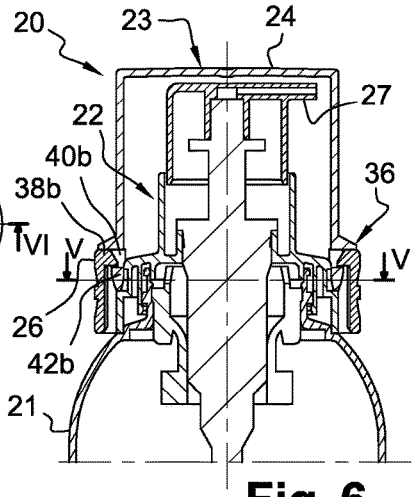
FIG. 6 is a view in axial section, along the line VI-VI of FIG. 5, of the closure device shown in the preceding figures.

The snap-fitting means 36 shown in FIGS. 3 and 6 comprise:

- three pairs of snap-fitting projections 38*a*, 38*b*, 38*c* carried by the internal face of the security ring 26,
- three pairs of complementary snap-fitting orifices 40*a*, 40*b*, 40*c* created in the cap 24.

The snap-fitting projections of each pair 38*a*, 38*b*, 38*c* are arranged essentially diametrically opposite one another on the internal face of the security ring 26 and are angularly offset with respect to the security projections 32 designed to engage with the collar 28 of the dispensing tip 22. The three pairs of snap-fitting projections 38*a*, 38*b*, 38*c* engage by form fit with the three pairs of complementary snap-fitting orifices 40*a*, 40*b*, 40*c* of the cap 24 so as to remain in a form fit in these snap-fitting orifices 40*a*, 40*b*, 40*c* upon ovalization of the security ring 26. Thus, the security ring 26 always remains snap-fitted on the cap 24.

Each snap-fitting orifice 40*a*, 40*b*, 40*c* is furthermore delimited by a ramp 42*a*, 42*b* for retracting the corresponding snap-fitting projection 38*a*, 38*b*, 38*c*.

Taking into account the relative movement for snap-fitting the security ring 26 onto the cap 24, the three pairs of snap-fitting projections 38*a*, 38*b*, 38*c* of the security ring 26 are thus arranged so as to engage with the three pairs of snap-fitting orifices 40*a*, 40*b*, 40*c* of the cap 24, each via these retracting ramps 42*a*, 42*b* before form-fitting each snap-fitting projection in the corresponding snap-fitting orifice 40*a*, 40*b*, 40*c*.

As stated above, in the separation position (shown in FIGS. 1, 10 and 11) corresponding to the deactivation of the closure device 23 of the cap 24 on the container 21, each axial locking abutment 30 of the security ring 26 is separated from the axial locking abutment 29 of the container 21 to allow the cap 24 to be freed from the container 21.

There follows a description of the principal steps of handling the medical device 20 according to the invention.

Reference is first made to the medical device 20 in its closed configuration as shown in FIG. 2. In this case, the cap 24 is snap-fitted onto the dispensing tip 22, the snap-fitting means 25 being activated as shown in FIGS. 4 to 6.

Figure 7:
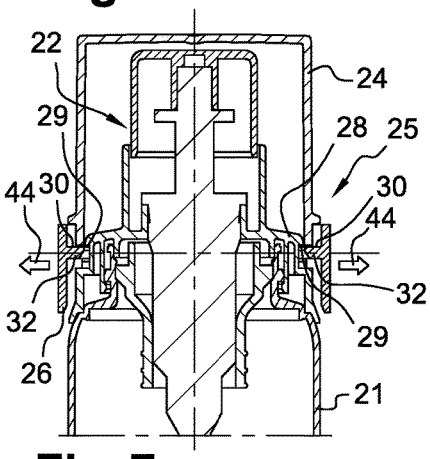
FIGS. 7 to 9 are views similar to FIGS. 4 to 6, the axial locking abutments being in their separation position allowing the cap to be freed from the container.
Figure 9:
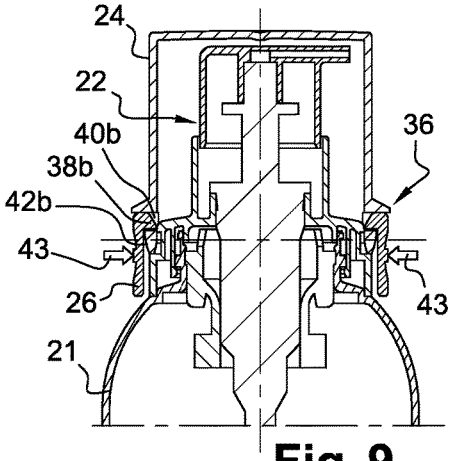
Figure 8:
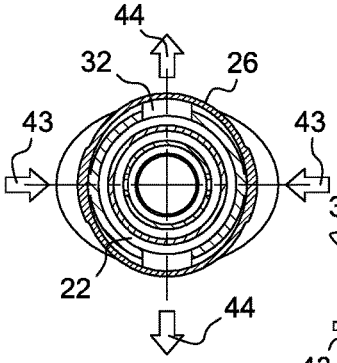

In order to separate the cap 24 from the dispensing tip 22, the user radially compresses the security ring 26 in the compression direction shown by arrows 43 in FIGS. 8 and 9. This causes the ovalization of the security ring 26 by elastic deformation of the latter so as to reduce its major axis (corresponding to the plane of section VI of FIG. 5) and extend its minor axis (corresponding to the plane of section IV of FIG. 5) in the direction shown by arrows 44 in FIGS. 7 and 8.

Since the security projections 32 are arranged on the internal surface of the security ring 26 so as to be essentially aligned with its minor axis which extends upon ovalization, the security projections 32 move away from the dispensing tip 22. This releases the axial locking abutments 30, carried by the security ring 26, from the axial locking abutment 29 carried by the dispensing tip 22.

Figure 10:
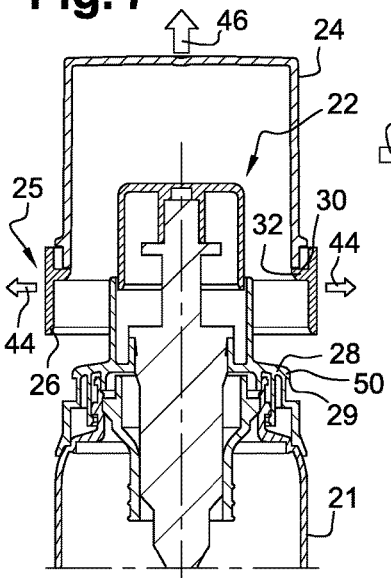
FIGS. 10 and 11 are views similar to FIGS. 7 and 9, the cap being separated from the container.
Figure 11:
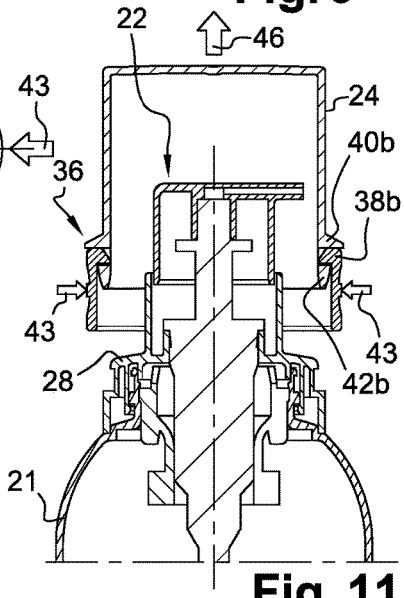

Then, in accordance with a usual motion, the user separates the cap 24 from the container 21 by moving the cap 24 axially with respect to the dispensing tip 22, in the direction of the arrow 46 shown in FIGS. 10 and 11. The medical device 20 is then in its open configuration as shown in FIG. 1.

It is to be noted that the means 36 for snap-fitting the security ring 26 onto the cap 24 remain active regardless of whether or not the security ring 26 is ovalized or even if the cap 24 is removed 46 from the container 21. Indeed, as shown in FIGS. 9 and 11, the three pairs of snap-fitting projections 38*a*, 38*b*, 38*c* of the security ring 26 remain form-fitted in the three pairs of snap-fitting orifices 40*a*, 40*b*, 40*c* of the cap 24 upon ovalization of the security ring 26.

In order to re-close the medical device 20, the user snap-fits the cap 24 onto the dispensing tip 22 by moving it essentially axially (parallel to the axis A) toward this dispensing tip 22.

It is to be noted that a retracting ramp 50 is created on the collar 28 of the dispensing tip 22.

Thus, when the cap 24 is moved so as to snap-fit it onto the dispensing tip 22, each security projection 32 is retracted by engagement with the retracting ramp 50 carried by the dispensing tip 22 (and thus the container 21). This retraction, which allows the security projections 32 to pass the collar 28, thus precedes the axial locking abutments 29, 30 of the dispensing tip 22 and of the security ring 26 being placed in the cooperation position.

Once the axial locking abutments 29, 30 are in engagement, the cap 24 is held on the dispensing tip 22, as shown in FIG. 2.

There follows, with reference to FIGS. 12 to 17, a description of other embodiments of the invention. In these FIGS. 12 to 17, those elements which are analogous to those of the preceding figures are designated with identical references.

Figure 12:
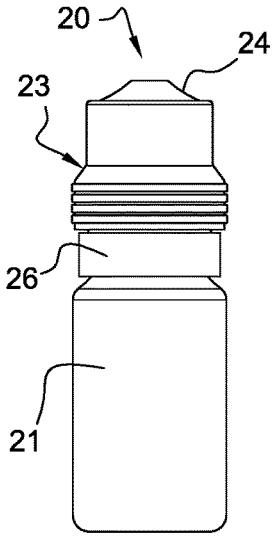
FIG. 12 is a side view of a medical device comprising a closure device, according to a second embodiment of the invention, affixed to a container.
Figure 13:
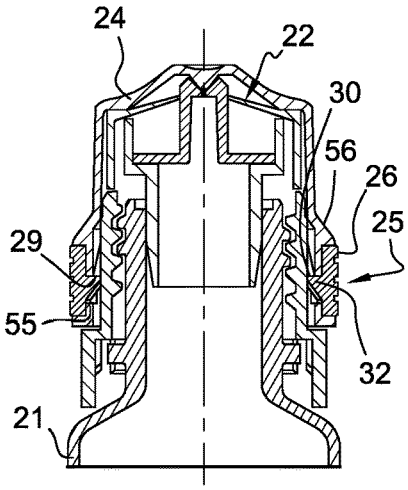
FIG. 13 is a view in axial section, similar to FIG. 4, of the closure device shown in FIG. 12.

FIGS. 12 and 13 show a medical device 20 comprising a closure device 23 according to a second embodiment of the invention. This closure device 23 is affixed to the container 21.

In this case, the dispensing tip 22 is a dropper, the operation of which is known per se. The dispensing tip 22 is screwed onto a threaded neck 52 of the container 21.

Furthermore, the means 36 for snap-fitting the security ring 26 onto the cap 24 comprise in this case an annular channel 54 created in the cap 24. The security ring 26 is form-fitted into this annular channel 54 and remains form-fitted therein upon ovalization of the security ring 26, preventing the cap 24 and the security ring 26 from being separated.

As shown in FIG. 13, each security projection 32 of the security ring 26 extends radially, from the internal surface of the security ring 26 toward the security projection 32 diametrically opposite, through an orifice 55 in the cap 24.

It is to be noted that the annular channel 54 is delimited by a ramp 56 for the radial elastic expansion of the security ring 26. This radial elastic expansion ramp 56 is annular and designed to engage with this security ring 26 before form-fitting of this security ring 26 in the annular channel 54, taking into account the essentially axial snap-fitting relative movement between the security ring 26 and the cap 24.

Figure 14:
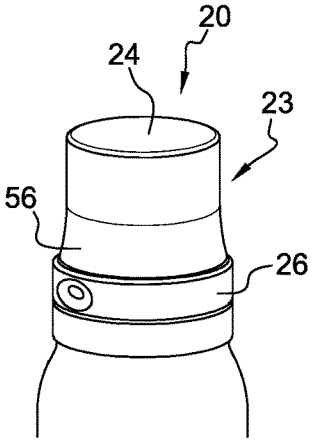
FIGS. 14 and 15 are perspective views, similar to FIGS. 2 and 3, of a medical device comprising a closure device according to a third embodiment of the invention.
Figure 15:
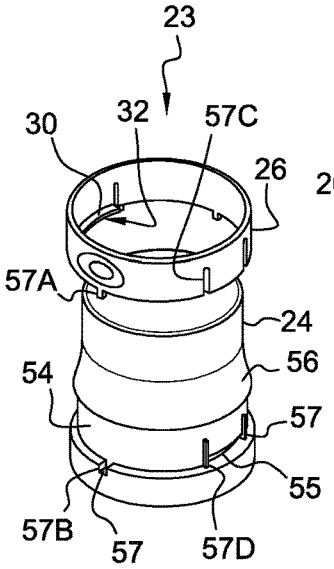

FIGS. 14 and 15 show a medical device 20 comprising a closure device 23 according to a third embodiment of the invention. This closure device 23 is mounted on the container 21.

As in the second embodiment, the security ring 26 is form-fitted into the annular channel 54 and remains form-fitted therein upon ovalization of this security ring 26. Similarly, each security projection 32 of the security ring 26 extends radially, from the internal surface of the security ring 26 toward the security projection 32 diametrically opposite, through an orifice 55 in the cap 24.

However, in the third embodiment of the invention, the closure device 23 comprises angular immobilization means 57 having complementary shapes, created on the security ring 26 and the cap 24. In the example shown in FIG. 15, the immobilization means 57 comprise, on one hand, axial spurs 57A secured to one end of the security ring 26 and form-fitted into axial notches 57B created in one edge of the annular channel 54 and, on the other hand, axial notches 57C created in the same end as above of the security ring 26, form-fitted into axial ribs 57D arranged on the cap 24, at the bottom of the annular channel 54, on either side of an orifice 55 through which a security projection 32 is to pass.

The immobilization means 57 permit the angular immobilization of the security ring 26 in the channel 54. At least part of these immobilization means 57 remain active upon ovalization of the security ring 26.

Figure 16:
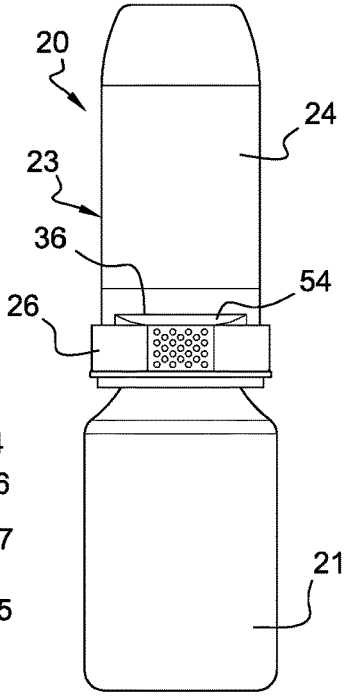
FIGS. 16 and 17 are side views of a medical device comprising a closure device, respectively according to fourth and fifth embodiments of the invention.
Figure 17:
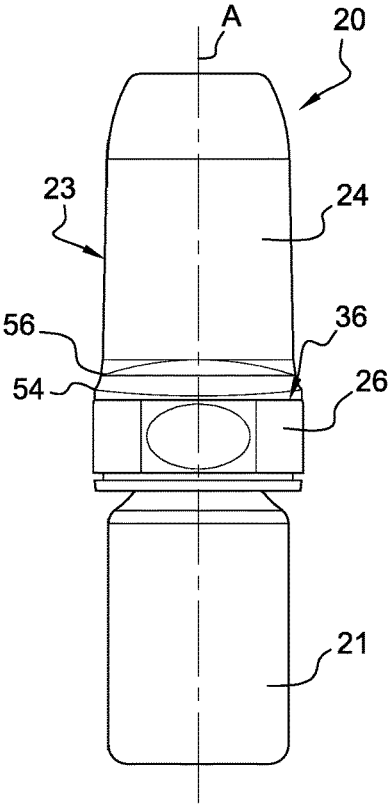

FIGS. 16 and 17 each show a medical device 20 comprising a closure device 23, respectively according to fourth and fifth embodiments of the invention.

In the case of FIG. 16, the means 36 for snap-fitting the security ring 26 onto the cap 24 comprise two portions, diametrically opposite one and the same annular channel 54, created in the cap 24. The security ring 26 is form-fitted into these two portions of the annular channel 54.

In the case of FIG. 17, the expansion ramp 56, designed to engage with the security ring 26 before it is form-fitted into the annular channel 54, has a slope which changes about the axis A.

The invention is not restricted to the embodiments presented hereinabove and other embodiments will be readily apparent to a person skilled in the art.

In particular, it is to be noted that the axial locking abutment 29 may be carried by a member for retaining the cap 24 on the container 21, other than a tip for dispensing product. This retaining member may be mounted on the container 21 or made in one piece with this container 21.

Furthermore, in order to retain the closure device 23 on the container 21, it is possible to provide means other than means 25 for snap-fitting the cap 24 onto the dispensing tip 22, for example means for screwing the cap 24 onto a member for retaining the cap 24 mounted on the container 21 or made in one piece with this container 21.

What is claimed is:

1. A closure device for closing a container, comprising:

a cap intended to be placed on the container or to be removed from that container by a relative movement between the cap and the container, the relative movement including an axial component;

a security ring mounted around the cap so as to allow radial elastic deformation of the security ring by ovalization when the security ring is compressed radially in at least one compression direction, the security ring carrying at least two essentially diametrically opposite security projections, each provided with an axial locking abutment that can be moved radially between:

a cooperation position, favored by elastic biasing, in which the axial locking abutment is intended to cooperate with a complementary axial locking abutment carried by the container to retain the cap on the container, and a separation position, in which the axial locking abutment is intended to be separated from the complementary axial locking abutment carried by the container to allow the release of the cap relative to the container;

the security projections being arranged on an internal surface of the security ring and aligned in a direction essentially perpendicular to the compression direction;

the radial position of each axial locking abutment carried by the security ring changing, by ovalization of this security ring, from its cooperation position to its separation position;

said closure device further comprising a mechanism for snap-fitting the security ring onto the cap, which can be activated by an essentially axial relative movement between the security ring and the cap, the mechanism for snap-fitting the security ring onto the cap being active regardless of whether or not the security ring is ovalized;

wherein the security ring is generally oval in shape with a minor axis and a major axis, the two security projections being essentially aligned with the minor axis of the security ring, the security ring being ovalized by deforming it elastically so as to reduce the major axis.

2. The closure device as claimed in claim 1, in which each security projection arranged on the security ring extends radially, from the internal surface of the security ring toward the security projection diametrically opposite, through a notch or an orifice of the cap.

3. The closure device as claimed in claim 1, in which the mechanism for snap-fitting the security ring onto the cap comprises at least one annular channel portion created in the cap, into which a portion of the security ring at least partially fits, the security ring remaining fitted in the channel portion upon ovalization of the security ring.

4. The closure device as claimed in claim 3, in which the annular channel portion is delimited by a ramp for radial elastic expansion of the security ring, designed to engage with this security ring before form-fitting of this security ring, taking into account the essentially axial snap-fitting relative movement between the security ring and the cap.

5. The closure device as claimed in claim 3, in which the security ring is angularly immobilized around the cap by an immobilization mechanism having complementary shapes created on the security ring and the cap, at least one part of the immobilization mechanism having immobilizing shapes remaining active upon ovalization of the security ring.

6. A medical device, comprising:

a container; and the closure device as claimed in claim 1.

7. The medical device as claimed in claim 6, wherein the complementary axial locking abutment forms part of the mechanism for snap-fitting the cap onto the container.

8. The medical device as claimed in claim 7, in which, taking into account the essentially axial relative movement for snap-fitting the cap onto the container, each security projection is designed to engage with a ramp for retracting this security projection carried by the container before the axial locking abutment of each security projection is put in the cooperation position.

9. The medical device as claimed in claim 6, in which the complementary axial locking abutment is carried by a member for retaining the cap on the container, this retaining member, being intended to be mounted on the container or being made in one piece with this container.

10. A medical device, comprising:

a container;

a cap intended to be placed on the container or to be removed from that container by a relative movement between the cap and the container, the relative movement including an axial component;

a security ring mounted around the cap so as to allow radial elastic deformation of the security ring by ovalization when the security ring is compressed radially in at least one compression direction, the security ring carrying at least two essentially diametrically opposite security projections, each provided with an axial locking abutment that can be moved radially between:

a cooperation position, favored by elastic biasing, in which the axial locking abutment is intended to cooperate with a complementary axial locking abutment carried by the container to retain the cap on the container, and a separation position, in which the axial locking abutment is intended to be separated from the complementary axial locking abutment carried by the container to allow the release of the cap relative to the container;

the security projections being arranged on an internal surface of the security ring and aligned in a direction essentially perpendicular to the compression direction;

the radial position of each axial locking abutment carried by the security ring changing, by ovalization of this security ring, from its cooperation position to its separation position;

said closure device further comprising a mechanism for snap-fitting the security ring onto the cap, which can be activated by an essentially axial relative movement between the security ring and the cap, the mechanism for snap-fitting the security ring onto the cap being active regardless of whether or not the security ring is ovalized;

wherein the complementary axial locking abutment is carried by a member for retaining the cap on the container, this retaining member, being intended to be mounted on the container or being made in one piece with this container;

wherein the retaining member forms a tip for dispensing a product contained in the container.

11. The medical device as claimed in claim 7, in which the complementary axial locking abutment is carried by a member for retaining the cap on the container, this retaining member, being intended to be mounted on the container or being made in one piece with this container.

12. The medical device as claimed in claim 8, in which the complementary axial locking abutment is carried by a member for retaining the cap on the container, this retaining member, being intended to be mounted on the container or being made in one piece with this container.

13. A closure device for closing a container, comprising:

a cap intended to be placed on the container or to be removed from that container by a relative movement between the cap and the container, the relative movement including an axial component;

a security ring mounted around the cap so as to allow radial elastic deformation of the security ring by ovalization when the security ring is compressed radially in at least one compression direction, the security ring carrying at least two essentially diametrically opposite security projections, each provided with an axial locking abutment that can be moved radially between:

a cooperation position, favored by elastic biasing, in which the axial locking abutment is intended to cooperate with a complementary axial locking abutment carried by the container to retain the cap on the container, and a separation position, in which the axial locking abutment is intended to be separated from the complementary axial locking abutment carried by the container to allow the release of the cap relative to the container;

the security projections being arranged on an internal surface of the security ring and aligned in a direction essentially perpendicular to the compression direction;

the radial position of each axial locking abutment carried by the security ring changing, by ovalization of this security ring, from its cooperation position to its separation position;

said closure device further comprising a mechanism for snap-fitting the security ring onto the cap, which can be activated by an essentially axial relative movement between the security ring and the cap, the mechanism for snap-fitting the security ring onto the cap being active regardless of whether or not the security ring is ovalized;

wherein each security projection arranged on the security ring extends radially, from the internal surface of the security ring toward the security projection diametrically opposite, through a notch or an orifice of the cap.

14. The closure device as claimed in claim 4, in which the security ring is angularly immobilized around the cap by an immobilization mechanism having complementary shapes created on the security ring and the cap, at least one part of the immobilization mechanism having immobilizing shapes remaining active upon ovalization of the security ring.

* * * * *